US005787785A

United States Patent [19]

Muenzel et al.

[11] Patent Number: 5,787,785

[45] Date of Patent: Aug. 4, 1998

[54] METHOD AND DEVICE FOR PROGRAMMING TIME FUSES OF PROJECTILES

[75] Inventors: Klaus Muenzel, Flüestrasse; Markus Engler, Zilstrasse, both of Switzerland

[73] Assignee: Oerlikon Contraves Pyrotec AG, Zurich, Switzerland

[21] Appl. No.: 678,228

[22] Filed: Jul. 11, 1996

[30] Foreign Application Priority Data

Sep. 28, 1995 [CH] Switzerland ..... 02744/95

[51] Int. Cl.[6] ..... F42C 15/40; F42C 17/00

[52] U.S. Cl. ..... 89/6.5; 102/266; 235/408

[58] Field of Search ..... 89/6.5, 6; 102/266, 102/271; 434/24; 235/408

[56] References Cited

U.S. PATENT DOCUMENTS

| | | | |
|---|---|---|---|
| 3,653,324 | 4/1972 | Furlani et al. | 102/206 |
| 3,955,069 | 5/1976 | Ziemba | 89/6.5 |
| 4,022,102 | 5/1977 | Ettel | 89/6.5 |
| 4,091,734 | 5/1978 | Redmond et al. | 89/6.5 |
| 4,267,776 | 5/1981 | Eickerman | 102/215 |
| 4,283,989 | 8/1981 | Toulios et al. | 89/6.5 |
| 4,649,796 | 3/1987 | Schmidt | 89/6.5 |
| 4,664,013 | 5/1987 | Wegner et al. | 89/6.5 |
| 4,955,279 | 9/1990 | Nahrwold | 89/6.5 |
| 5,473,986 | 12/1995 | Hau | 102/206 |
| 5,497,704 | 3/1996 | Kurschner et al. | 102/264 |

FOREIGN PATENT DOCUMENTS 0 300 255 1/1989 European Pat. Off. .

*Primary Examiner*—Michael J. Carone
*Assistant Examiner*—Christopher K. Montgomery
*Attorney, Agent, or Firm*—Browdy and Neimark

[57] ABSTRACT

In this more cost-effective, less elaborate method, the disintegration time is calculated from a predetermined muzzle velocity and a distance to the target and is transmitted to a receiver coil prior to firing. The receiver coil is connected via a comparator circuit (7) and a decoder (8) with a shift register (9), whose output is connected to a first comparator (6), so that the disintegration time is present on the outputs of the latter. A first counter (1), which is connected with a clock generator (2) and a programmable counter (3), is unblocked or blocked by the start-stop pulses, supplied via the receiver coil, of a muzzle velocity measuring device. The programmable counter (3) forms a clock signal from the number of the clock pulses, added in the first counter (1) during the unblocked time, and of the clock generator frequency, whose frequency is equal to the muzzle velocity and is supplied via a is binary circuit (4) to a second counter (5). The output of the second counter (5) is connected with the first comparator (6), wherein a firing signal (Z) appears at the output of the first capacitor (6) when the counter reading of the second counter (5) and the reading of the shift register (9) are the same.

17 Claims, 7 Drawing Sheets

9, FIG. 1
CP
b0
8
26
c5
27
START
STOP
Q1
D1
Q1
18
14
15
17
a2
b3
16
25
24
23
b6
b2
b1
V1
V2
V3
R1
R2
R3
R4
7
13
11
21
22
19
20
12
28
29

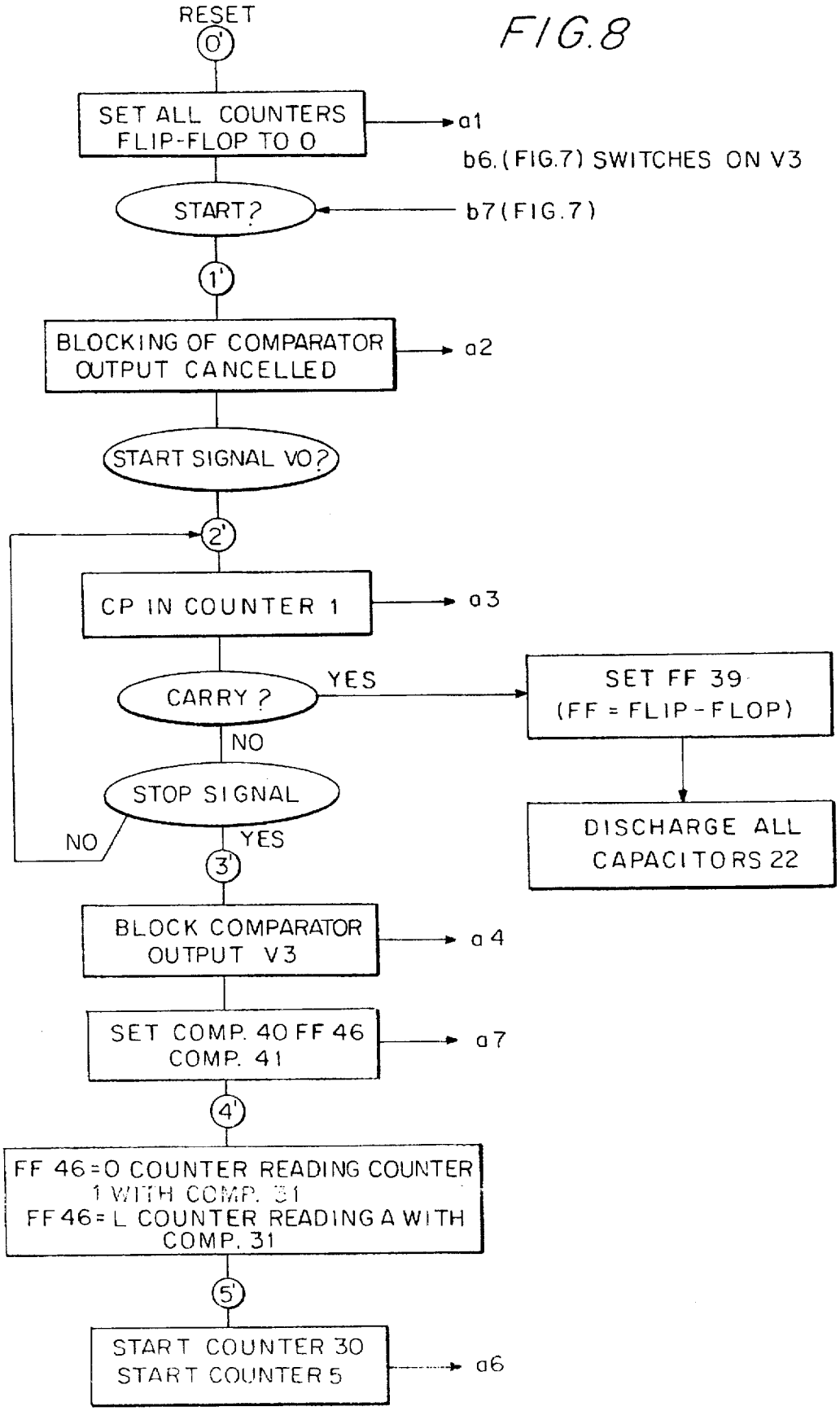
FIG.8
RESET
0'
SET ALL COUNTERS FLIP-FLOP TO 0
a1
b6.(FIG.7) SWITCHES ON V3
START?
b7(FIG.7)
1'
BLOCKING OF COMPARATOR OUTPUT CANCELLED
a2
START SIGNAL VO?
2'
CP IN COUNTER 1
a3
CARRY ?
YES
SET FF 39 (FF = FLIP-FLOP)
NO
STOP SIGNAL
NO
YES
DISCHARGE ALL CAPACITORS 22
3'
BLOCK COMPARATOR OUTPUT V3
a4
SET COMP. 40 FF 46 COMP. 41
a7
4'
FF 46=0 COUNTER READING COUNTER 1 WITH COMP. 31
FF 46=L COUNTER READING A WITH COMP. 31
5'
START COUNTER 30
START COUNTER 5
a6

METHOD AND DEVICE FOR PROGRAMMING TIME FUSES OF PROJECTILES

FIELD OF THE INVENTION

The invention relates to a method and a device for programming time fuses of projectiles, wherein a disintegration time which determines the firing time of a projectile is calculated and is transmitted in the form of a multi-bit programming word from a transmitter coil to a receiver coil provided in the projectile.

BACKGROUND OF THE INVENTION

A method has become known from European Patent Application 0 300 255, which contains a measuring device for the projectile velocity, disposed at the muzzle of a gun barrel. The measuring device consists of two toroid coils spaced apart from each other at a defined distance. Because of the change in magnetic flux occurring in the course of the passage of a projectile through the two toroid coils, pulses are generated in quick succession in each of the toroid coils. These pulses are supplied to an electronic evaluation device, in which the velocity of the projectile is calculated from the distance in time of the pulses and the distance between the toroid coils. Viewed in the direction of movement of the projectile, transmitter coil is disposed downstream of the measuring device for the velocity, which cooperates with a receiver coil provided in the projectile. The receiver coil is connected with a counter via a high-pass filter, whose output side is connected with a time fuse. A time value is formed from the calculated projectile velocity and an otherwise determined distance from a target object, which is inductively transmitted to the projectile immediately after its passage through the measuring device. The time fuse is set with the time value so that the projectile can be disintegrated in the area of the target object. The time value is transmitted in digital form from the transmitter coil to the receiver coil, wherein at least one 12-bit programming word is necessary for the required accuracy. Since in this device the projectile flies through the transmitter coil at a high velocity (for example approximately 1200 meters per second), and limits are set to the coil length, the 12-bit programming word must be transmitted at the correct time and at a relatively high frequency. The high frequency is achieved in that the pulses of the 12-bit programming word are double pulses, by means of which the dead time between the individual signals is considerably shortened.

To meet the height requirements of the above described device, a fast computer and further extensive hardware are required for its realization, which results in relatively high system costs. The electronic devices in the projectile are equipped with a surge generator for the energy supply during the projectile acceleration, and with a relatively expensive precision oscillator, which further increase the costs.

OBJECT AND SUMMARY OF THE INVENTION

The object of the invention is to propose a method and a device of the type mentioned at the outset, which is suitable for applications having low requirements and which is more cost-effective.

This object is attained by the invention recited in claims 1 and 8. Here, the disintegration time is calculated from a predetermined muzzle velocity of the projectile and from the distance from a target object and is transmitted to the receiver coil prior to firing. The receiver coil is connected to a comparator circuit, which is connected with a shift register via a decoder. The shift register is connected with a first comparator on its output side, so that the disintegration time received by the receiver coil is present at its inputs in the form of a multi-bit programming word. A first counter, connected with a clock generator and a programmable counter, is unblocked or blocked by means of start-stop pulses from a measuring device of the muzzle velocity supplied via the receiver coil. The programmable counter forms a clock signal from the number of clock pulses from the first counter stored during the unblocked time and the clock generator frequency, whose frequency is proportional to the muzzle velocity ($v_o$) and which is supplied to a second counter via a binary circuit. The output of the second counter is connected with the first comparator, wherein in the case of the count of the second counter and the reading of the shift register corresponding to the disintegration time being equal, a firing signal occurs at the output of the first comparator.

The advantages achieved with the invention are to be found in that it is possible, by means of the proposed calculation of the disintegration time in accordance with a predetermined muzzle velocity and the transmission of the disintegration time to the projectile prior to its being fired, to realize a simpler and more cost-effective device, which is better suited for weapons with slower projectile velocities. In contrast to the previously mentioned prior art, no external muzzle velocity measuring installation and no expensive processor for correcting the programmed disintegration time are required and the interference with programming by signals of the measuring coils for the muzzle velocity calculation is avoided. In place of a precision oscillator, which must be exactly aligned with a defined frequency, the device in accordance with the invention employs a clock generator with a satisfactory short-time stability, which does not need to be aligned. The surge generator used in the device according to the prior art is omitted, since the energy for the current supply of the time fuse is inductively transmitted.

The invention will be described in detail below by means of an exemplary embodiment in connection with the drawings.

BRIEF DESCRIPTION OF THE DRAWINGS

FIG. 8 is a second flow diagram of the sequence control of the device.

DETAILED DESCRIPTION OF THE PREFERRED EMBODIMENT

Figure 1:
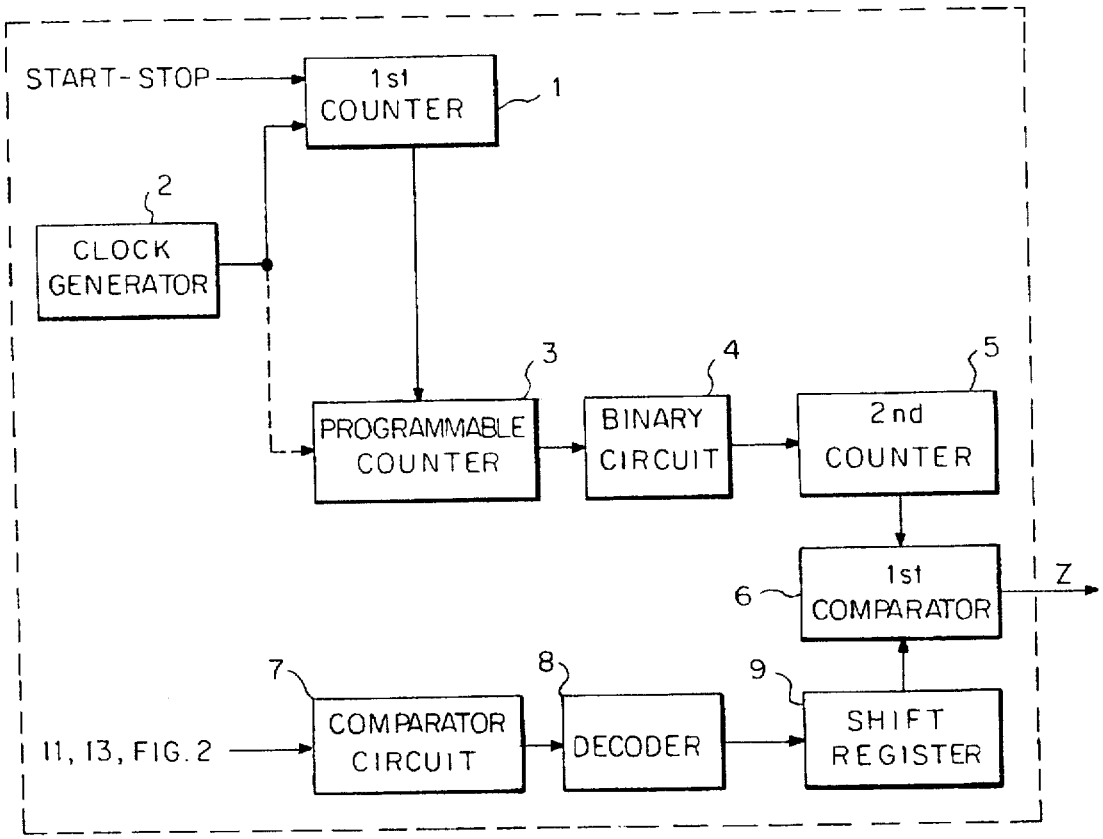
FIG. 1 is a block diagram of the device in accordance with the invention.
Figure 3:
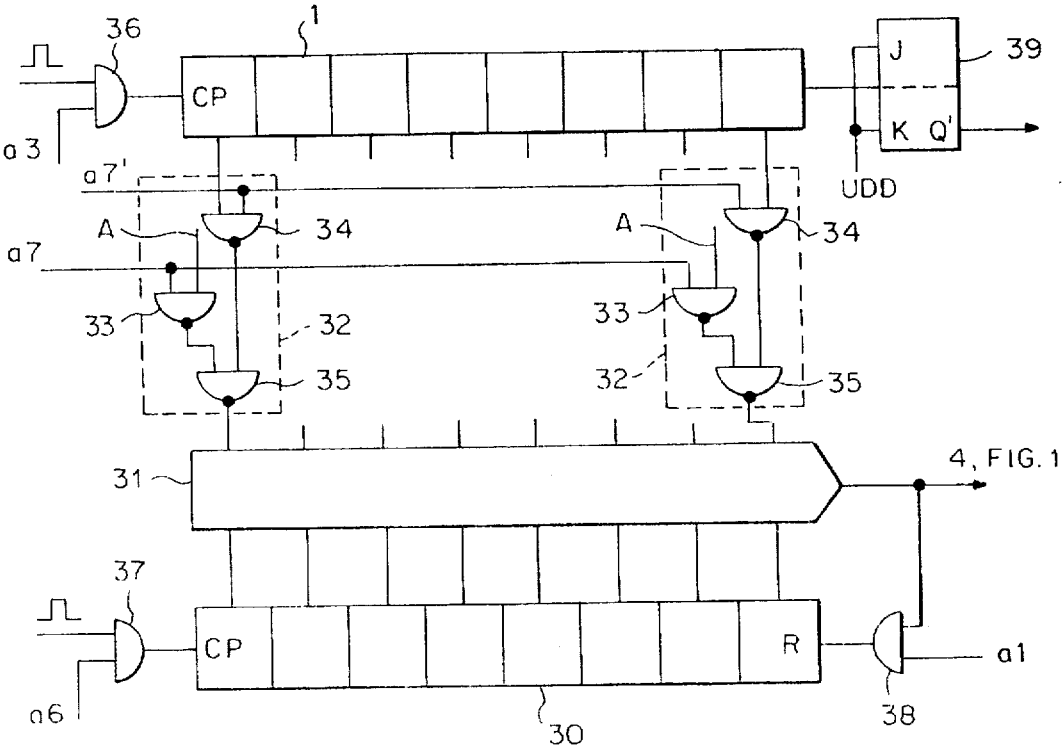
FIG. 3 is a programmable counter of the device.

A first counter, which is connected with a clock generator 2 and a programmable counter 3, described in more detail by means of FIG. 3, is identified by 1 in FIG. 1. The first counter 1 can be, unblocked or blocked by means of start-stop pulses of the coils of a measuring device for the muzzle velocity, known from EP-A-0 300 255, for example. On the input side, the programmable counter 3 is connected with the clock generator 2, and on the output side via a binary circuit 4 at the input of the second counter 5, the output side of which is connected with a first comparator 6. The comparator circuit 7, which is supplied at the input side with a 12-bit programming word representing a disintegration time T, is connected at the output side to a decoder 8, whose output is connected with a shift register 9. The shift register 9 is connected with the first comparator 6, at whose output a firing signal, symbolized by an arrow Z, appears, when the count of the second counter 5 and of the 12-bit programming word in the shift register 9 are the same.

Figure 2:
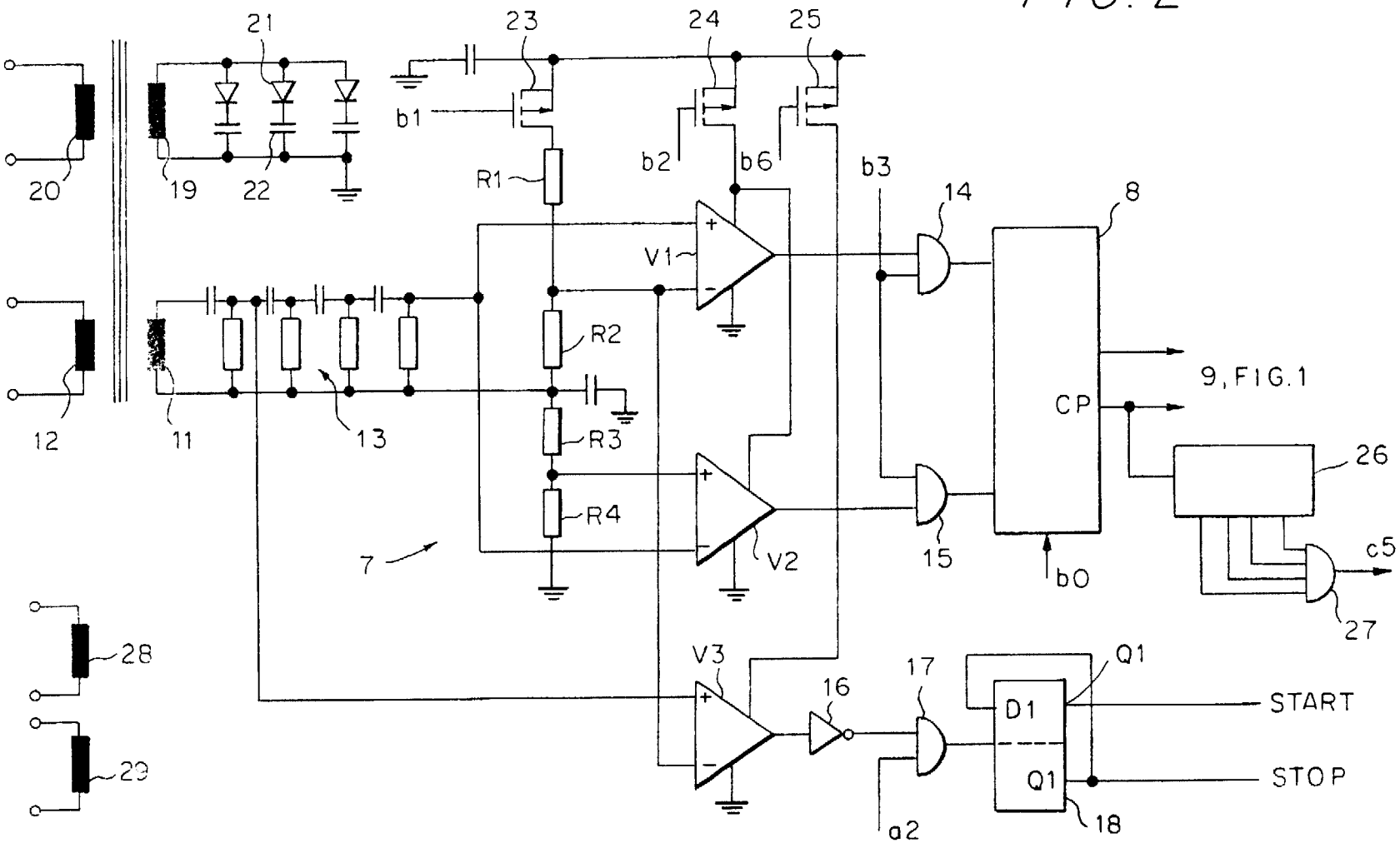
FIG. 2 is a circuit diagram of a portion of the device.
Figure 7:
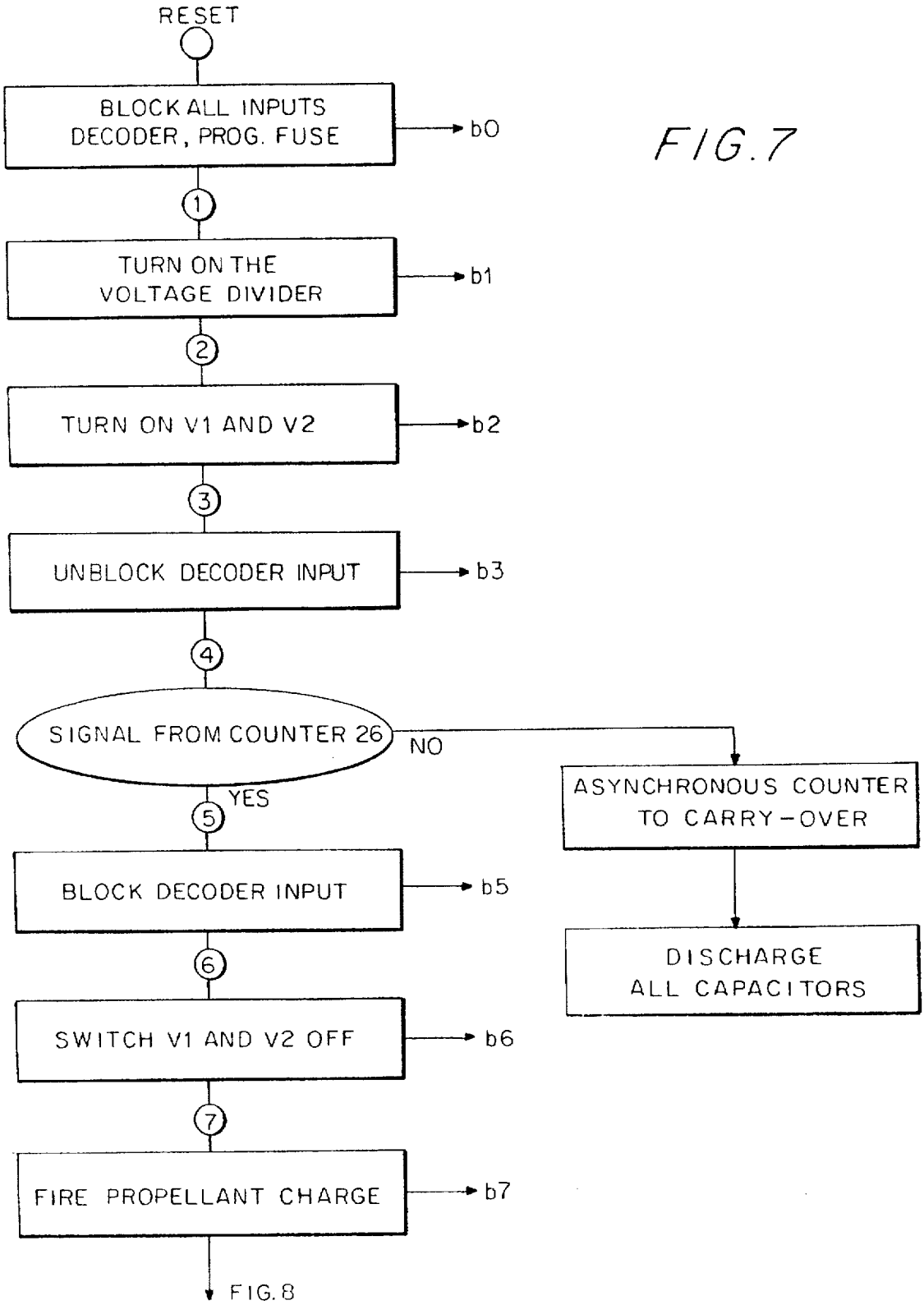
FIG. 7 is a first flow diagram of a sequence control.

A receiver coil 11 is provided in accordance with FIG. 2, which cooperates with a transmitter coil 12 disposed in a breach of a gun barrel. A high-pass filter 13 is placed downstream of the receiver coil 11 and consists of four individual high-pass filters, for example. The receiver coil 11 is connected with the comparator circuit 7 (FIG. 1) via the high-pass filter 13. The comparator circuit (7) consists of two comparators V1, V2, whose inputs are connected via a voltage divider, consisting of four resistors R1, R2, R3, R4, to the high-pass filter 13. The input voltage of the comparators V1, V2 induced in the receiver coil 11 can be set to a defined level by means of the voltage divider when a control signal b1 (FIG. 7) occurs. The outputs of the comparators V1, V2 are connected to AND gates 14, 15, which respectively have two inputs each, whose other inputs can be supplied with a control signal b3 for unblocking the comparator outputs, and whose outputs are connected with the inputs of the decoder 8. The input of a further comparator V3 is connected via the resistor R2 of the voltage divider to the receiver coil 11. The output of the further comparator V3 is connected via an inverter 16 and a further AND gate 17, having two inputs, with the clock connection of a D-flip-flop 18, whose data input D1 is connected with its complementary output Q1'. The clock connector of the D-flip-flop 18 can be unblocked by means of a control signal a2 provided to the second input of the further AND gate 17. Signals, which are derived from the start-stop signals of the measuring device for the muzzle velocity, occur at the outputs Q1, Q1' of the D-flip-flop 18, by means of which the first counter 1 can be unblocked or blocked (control signal a3, FIG. 3). A control counter 26 is connected to a clock output CP of the decoder 8, which checks the number of bits of the programming word to be transferred to the shift register 9. The outputs of the control counter 26 are connected with the inputs of an AND gate 27, at whose output a control signal c5 occurs, which signals the complete transmission of the programming word. The coils of the previously mentioned measuring device for the muzzle velocity disposed at the muzzle of the gun barrel are indicated by 28 and 29, which cooperate with the receiver coil 11 when a projectile is fired.

Three capacitors 22, which are series-connected with respectively one rectifier 21, are connected to a further receiver coil 19, which cooperates with a further transmitter coil 20 disposed in the breach of the gun barrel. The capacitors 22 are used for supplying the electronic device with current and to deliver the energy required for firing, for which purpose they are charged prior to firing by a brief application of an alternating voltage of 20 kHz, for example, to the further transmitter coil 20. Three switches, for example in the form of MOSFETs, are identified by 23, 24, 25 and are connected with a capacitor 22 used for the current supply via a stabilizer circuit, not shown. The voltage divider or the three comparators V1, V2, V3 can be connected to the voltage by means of control signals b1, b2, b6 supplied via the gate connections of the switches 22, 23, 24.

Figure 4:
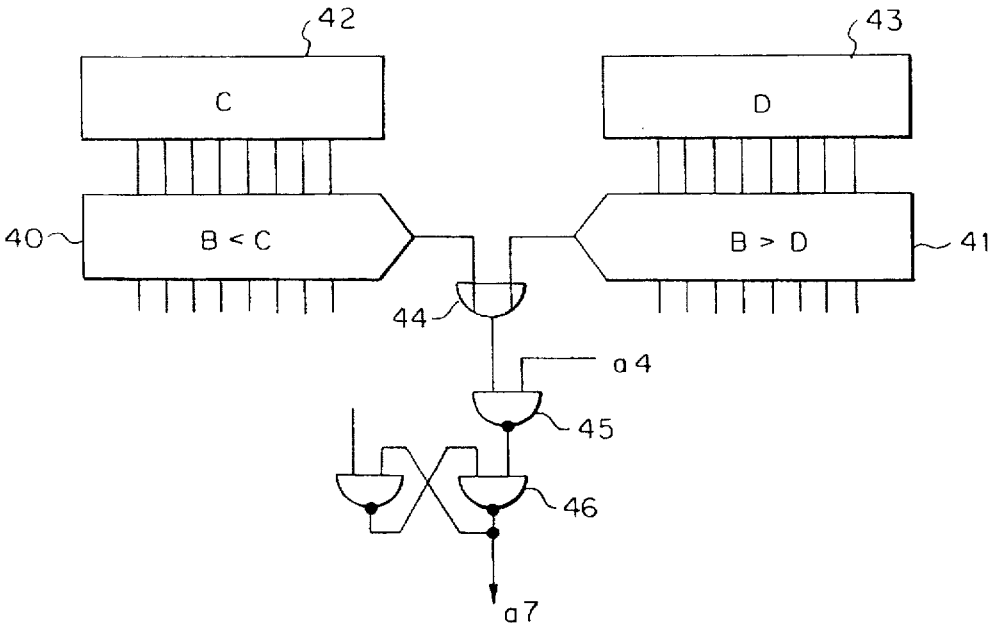
FIG. 4 is a correction circuit of the device.

In accordance with FIG. 3, the programmable counter 3 consists of a third counter 30 and a second comparator 31. The outputs of the third counter 30 are connected with the inputs of the second comparator 31, which has further inputs which are connected by respectively one gate arrangement 32 each with outputs of the first counter 1. The gate arrangement 32 consists of three NAND gates 33, 34, 35, each having two inputs, wherein the outputs of the first two NAND gates 33, 34 are connected with the inputs of the third NAND gate 35, whose output is connected with the appropriate input of the second comparator 31. Predetermined levels L or O, which form a counter reading A, are supplied to the one inputs of the first NAND gate 33, while a control signal a7, generated by a correction circuit, which will be described in more detail by means of FIG. 4, is supplied to the other inputs. The one inputs of the second NAND gate 34 are connected with the appropriate outputs of the first counter 1, while the other inputs are supplied with a control signal a7', which is complementary to the control signal a7. The clock inputs CP of the counters 1 and 30 are connected to outputs of AND gates 36, 37, each of which has two inputs, whose one inputs are connected with the clock generator 2 (FIG. 1). Control signals a3 or a6 are supplied to the other inputs, so that the counters 1 or 30 can be unblocked or blocked. The output of the second comparator 31 is connected with the binary circuit 4 (FIG. 1) and, via a further AND gate 38 having two inputs, with the reset connector (R) of the third counter 30. For the purpose of resetting the third counter 30, it is possible to supply the other input of the further AND gate 38 with with a control signal al. The carry-over connector of the first counter 1 is connected with the clock connector of a JK-flip-flop 39, at whose output Q' a discharge signal for the capacitors 22 can occur.

A third and fourth comparator, on whose inputs the counter reading B of the first counter 1 is present, are identified by 40 and 41 in FIG. 4. The third comparator 40 is connected via further inputs with the outputs of a first memory member 42, in which a lower limiting value C is stored. The fourth comparator 41 is connected via further inputs with the outputs of a second memory member 43, in which an upper limiting value D is stored. The outputs of the comparators 40, 41 are connected with the inputs of an OR gate 44, whose output is connected via a NAND gate 41, having two inputs, with the set input of an RS-flip-flop 46. A control signal a4 can be supplied to the second input of the NAND gate 45. The output of the RS-flip-flop 46, at which the control signal a7 can occur, is connected in a manner not further represented with the gate arrangements 32 (FIG. 3).

Figure 5A:
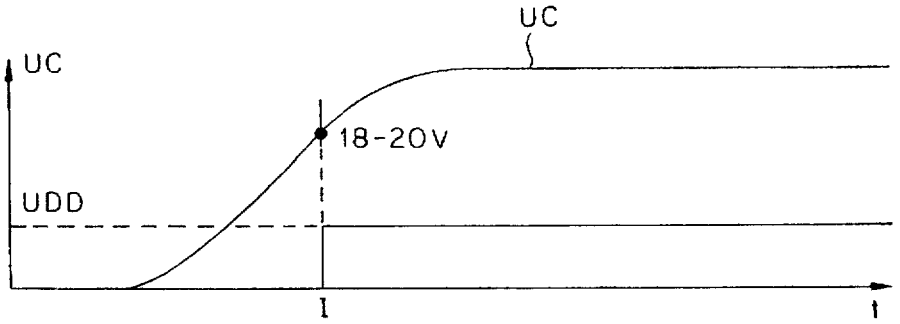
FIG. 5*a* is a diagram of the course of a charge voltage for capacitors and a supply voltage.
Figure 5B:
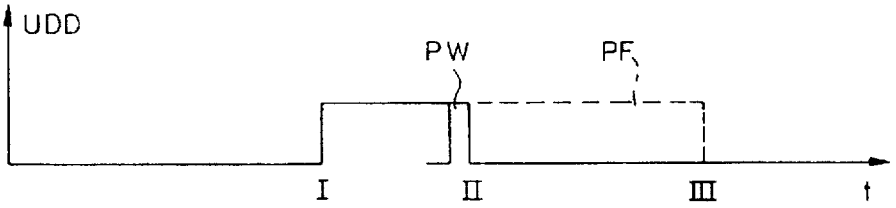
FIG. 5*b* is a diagram of the position of a programming window.

In accordance with FIGS. 5*a*, 5*b* and 5*d*, the horizontal axes are associated with the time t and the vertical axes with the voltage UC at the capacitors 22 or the supply voltage UDD of the electronic components of the device. A programming window is identified by PF, the 12-bit programming word occurring in the programming window PF by PW, and the control signal for firing a propellant charge by b7.

In FIGS. 6*a*, 6*b*, 6*c* and 6*d*, the horizontal axes are associated with the time t, and the vertical axes with the supply voltage UDD. The threshold voltage of the comparator V3 is identified by Us, half the supply voltage by UDD/2, and the clock signal present at the clock connector of the D-flip-flop 18 by TS. MZ is the signal appearing at the output Q1 of the D-flip-flop 18 between the start-stop pulses, which represents the length of the measurement of the muzzle velocity, O and L mean logical levels, as is customary.

Figure 9:
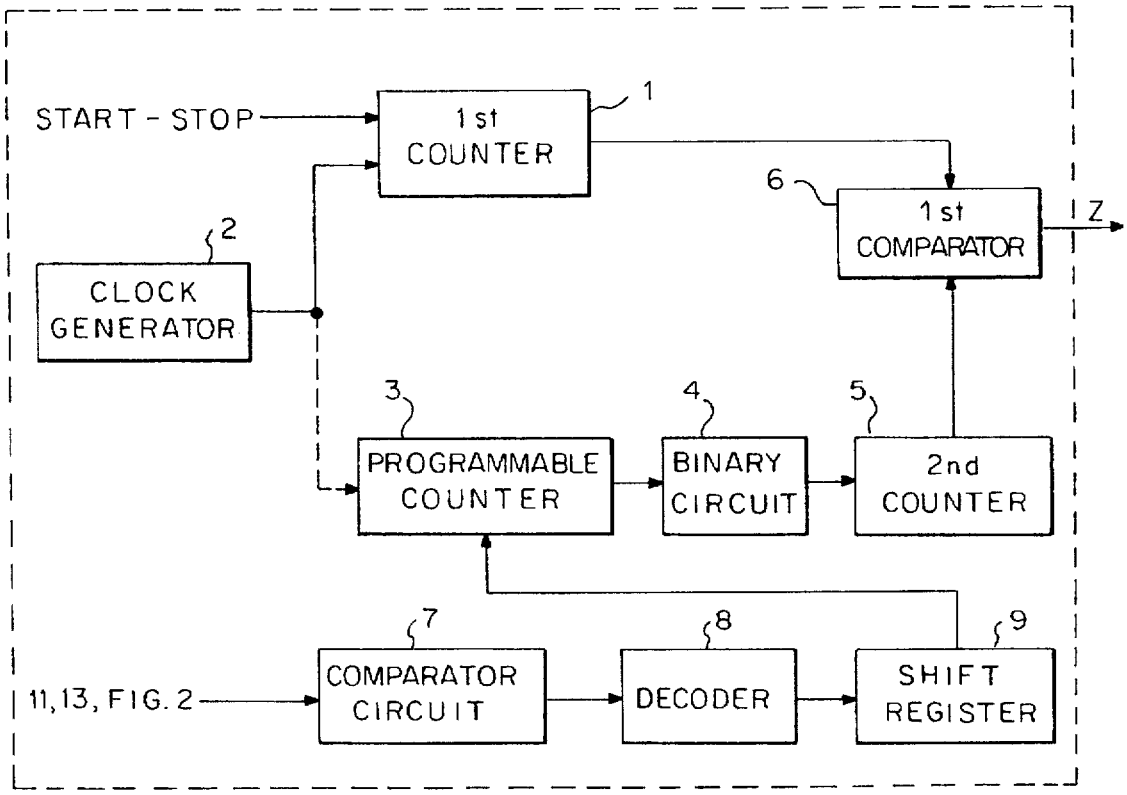
FIG. 9 is a block circuit diagram of a second embodiment of the device.

In contrast to FIG. 1, in FIG. 9, the first counter 1 is connected with the first comparator 6, instead of with the programmable counter 3, and the output of the shift register 9 is connected to the programmable counter 3 instead of to the first comparator 6. The outputs of the first counter 1 are connected via the gate arrangements 32 (FIG. 3) with inputs of the first comparator 6, which is not further shown, so that it is possible to provide it either with the counter reading B of the first counter 1 or the predertermined counter reading A (FIG. 3). The outputs of the shift register 9 are connected with the further inputs of the second comparator 31 (FIG. 31) of the programmable counter 3, which forms a clock signal for the second counter 5 by dividing the clock generator frequencies by the contents of the shift register 9 in a manner similar to the one described below for FIG. 1. When the counter readings A or B of the first counter 1 and the counter reading of the second counter 5 are equal, the first comparator 6 generates the firing signal Z.

It should be additionally noted that in contrast to FIG. 1, for the circuit in accordance with FIG. 9, the initial frequency $f_o'$ of the programmable counter 3 is proportional to the oscillator frequency $f_o$.

The above described device operates as follows:

Prior to firing the projectile, the distance s to the target is measured and the disintegration time T (flight time of the projectile) is determined, starting from a predetermined muzzle velocity $v_o$ of, for example, 300 meters per second. Thereafter the capacitors 22 (FIG. 2) are charged by the brief application of the alternating voltage of approximately 20 kHz to the further transmitter coil 20, wherein the high-pass filter 13 damps the charge signal sufficiently, so that the comparators V1, V2 connected with the receiver coil 11 cannot respond. The stabilizer circuit is switched on at a voltage UC of approximately 18 to 20 Volt and the clock generator 2 and a sequence control, whose most important steps can be seen in the flow diagrams in accordance with FIGS. 7 and 8, start to operate (time I, FIG. 5*a*). At approximately the same time the voltage divider R1 to R4 is raised to half the supply voltage by the control signal b1, and the two comparators V1 and V2 are switched on by the control signal b2 ((FIG. 2). Immediately thereafter the inputs of the decoder 8 are unblocked by the control signal b3 and the programming window PF is formed (FIGS. 2, 5*b*).

Subsequently, the disintegration time T in the form of a 12-bit programming word is transmitted by the transmitter coil 12 to the receiver coil 11, and is supplied via the comparator circuit 7 and the decoder 8 to the shift register 9. In the process, the control counter 26 adds up the twelve clock pulses of the decoder 8 or the shift register 9 required for the complete transmission, wherein the control signal c5 occurs at the output of the AND gate 27, by means of which a control signal b5 for blocking the inputs of the decoder 8 is generated (time II, FIG. 5*b*, FIG. 2). A control signal b6 is subsequently generated and the current supply for the comparators V1, V2 is turned off. If the control counter 26 counts fewer or more than twelve clock pulses, an asynchronous counter, not shown, started at the time I (FIG. 5*b*), continues to run to the carry-over, and by means of the control signal b3 the programming window PF is maintained open until the carry-over (time III, FIG. 5*b*), wherein the opening time may for example be 128 milliseconds. By means of this relatively long time it is achieved that the time of transmission for the chronologically considerably shorter 12-bit programming word PW can fluctuate within wide margins. If no or only an incomplete programming word is transmitted within the 128 milliseconds, the capacitors 22 are discharged by means of the transmission signal of the asynchronous counter, so that the shell can be removed from the gun barrel without danger.

Figure 5C:
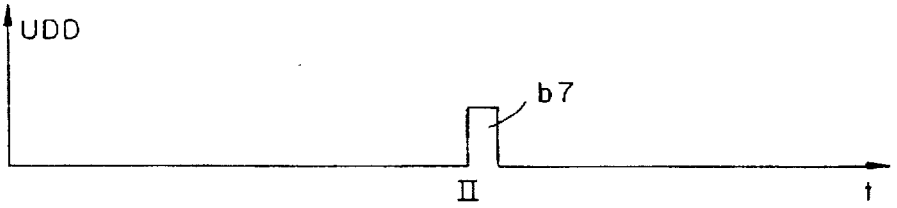
FIG. 5*c* is a diagram of the position of a firing signal for a propellant charge.
Figure 6A:
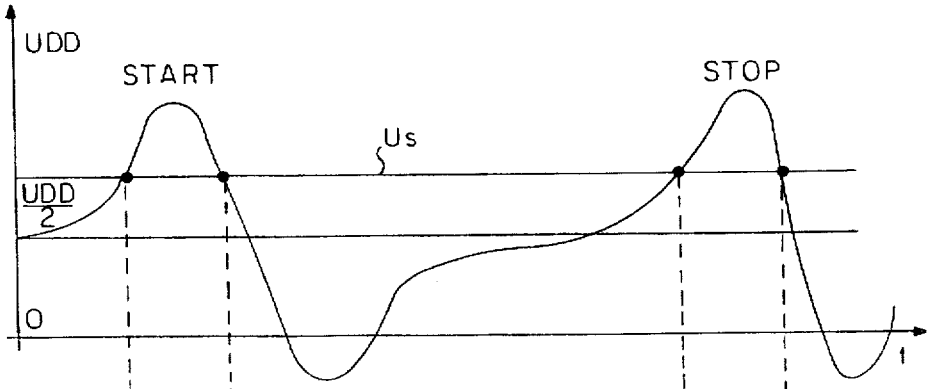
FIG. 6*a* is a diagram of the voltage path of start-stop pulses at a receiver coil.
Figure 6B:
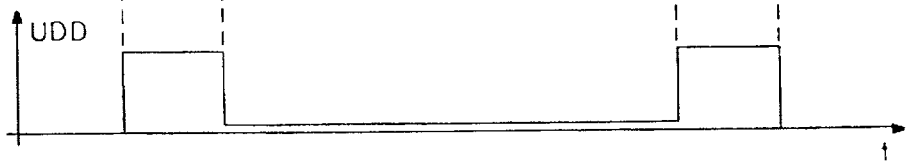
FIG. 6*b* is a diagram of the output signals of a comparator when start-stop pulses occur.
Figure 6C:
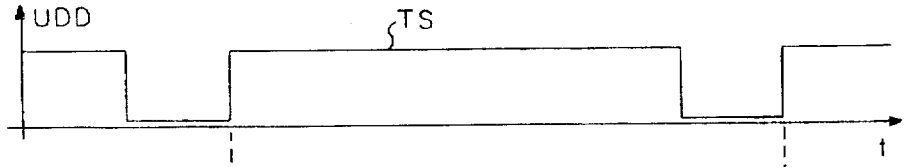
FIG. 6*c* is a diagram of the inverted output signals in accordance with FIG. 6*b*.
Figure 6D:
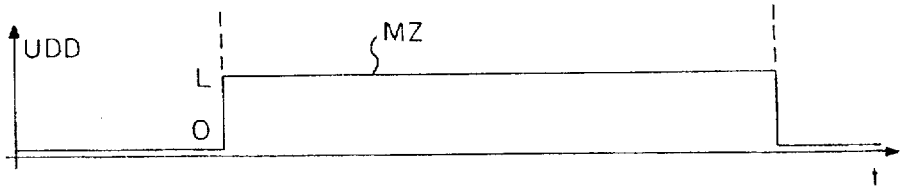
FIG. 6*d* is a diagram of the length of time of a measurement of a muzzle velocity.

Following the blockage of the inputs of the decoder 8 and switching off the comparators V1, V2 by the control signals b5 or b6, the control signal b7 is generated (FIG. 5*c*), by means of which the propellant charge of the projectile is ignited and it is fired off. Immediately thereafter the blockage of the output of the comparator V3 or of the clock connector of the D-flip-flop 18 are removed by means of the control signal a2 (FIG. 2). A start and a stop signal are generated shortly after each other when the measuring device for the muzzle velocity is passed and are transmitted by the coils 28, 29 to the receiver coil 11 and supplied to the further comparator V3, which had previously been switched on by the control signal b6. When the threshold voltage Us is exceeded in either direction, the comparator V3 generates rectangular pulses from the start and stop signals, which are inverted by the inverter 17 into a clock signal TS for the D-flip-flop 18 (FIGS. 6*a*, 6*b*, 6*c*, 2). The level O at the output QI of the D-flip-flop 18, which has initially been preset, is changed to L (FIG. 6*d*) in case of a positive edge of the clock signal TS, because of which the control signal a3 is generated and the first counter 1 is started, which now adds the clock pulses supplied by the clock generator 2. When stop pulses and the second positive edge of the clock signal TS appear, the level at the output Q1 returns to O again (FIGS. 6*c*, 6*d*). The control signal a4 is generated thereby, by means of which the clock input of the D-flip-flop 18, the output of the comparator V3 and the clock input CP of the first counter 1 are again blocked because of the disappearance of the control signal a3.

The number of clock pulses N1 added in the first counter 1 results from the equation $N1=(fo \cdot do)/v_o$, wherein fo is the clock frequency, do the distance between the coils of the measuring device and $v_o$ the predetermined muzzle velocity. If, for example, fo=300 kHz, do=0.15 m and $v_o$=300 m/sec, the result is N1=150. Since the measured muzzle velocity can differ from the predetermined muzzle velocity $v_o$, it is necessary to correct the added-up number of clock pulses N1. To this end the counter reading B of the first counter is supplied to the third and fourth comparators 40, 41 of the correction circuit (FIG. 4) and is compared with the limiting values C, D stored in the memory members 42, 43. If the counter reading B lies inside a range determined by the limiting values, no correction takes place. However, if the lower limiting value C is downwardly exceed or the upper limiting value D is upwardly exceeded, the control signal a7 appears at the output of the RS-flip-flop 56 (FIG. 4). It is achieved by means of this that in place of the differing counter reading B of the first counter 1, the counter reading A present at the one inputs of the NAND gates 33 of the gate arrangement 32, which corresponds to N1=150 clock pulses, is transmitted to the second comparator 31 (FIG. 3). In case of very large deviations the first counter 1 generates a carry-over signal, by means of which the discharge of the capacitors 22 is caused via the JK-flip-flop 39 (FIG. 3). Because of this measure, the shell can be unloaded without danger in case the muzzle velocity equals zero (failure to fire).

Following the transmission of the counter reading A or B of the first counter 1 to the second comparator 31, the third counter 30 is started by means of a control signal a6. It now adds up the clock pulses provided by the clock generator 2, wherein the second comparator 31 generates a signal every time the reading of the third counter 30 and the counter reading A or B are the same, by means of which the third counter 30 is reset via the AND gate 38 (FIG. 3). The clock generator frequency fo is divided by the number of clock pulses N1 in this way and a clock signal with the frequency fo'=fo/N1 is generated, which is supplied via the binary circuit 4 to the second counter 5 (FIG. 1). With the above described correction of the muzzle velocity, the frequency fo' becomes proportional to $v_o$, so that the product of the predetermined muzzle velocity $v_o$ and the calculated disintegration time T remains constant. When the reading of the second counter 5 and the 12-bit programming word in the shift register 9 are equal, the first comparator 6 generates the firing signal Z, whereupon the projectile is disintegrated. If the comparator 5 does not emit a firing signal Z, the carry-over signal of the second counter 5 triggers the firing, because of which the projectile self-destroys after 8.190 seconds if, for example, a 13-digit second counter 5 and a clock frequency of approximately 1 kHz have been selected.

List of Reference Numerals

1 First counter
2 Clock generator
3 Programmable counter
4 Binary circuit
5 Second counter
6 First comparator
7 Comparator circuit
8 Decoder
9 Shift Register
11 Receiver coil
12 Transmitter coil
13 High-pass filter
14 AND gate
15 AND gate
16 Inverter
17 AND gate
18 D-flip-flop
19 Receiver coil
20 Transmitter coil
21 Rectifier
22 Capacitors
23 Switch
24 Switch
25 Switch
26 Control counter
27 AND gate
28 Coil
29 Coil
30 Third counter
31 Second comparator
32 Gate arrangement
33 NAND gate
34 NAND gate
35 NAND gate
36 AND gate
37 AND gate
38 AND gate
39 JK-flip-flop
40 Third comparator
41 Fourth comparator
42 First memory member
43 Second memory member
44 OR gate
45 NAND gate
46 RS-flip-flop
Z Firing signal
V1 Comparator
V2 Comparator
V3 Comparator
A Counter reading (predetermined)
B Counter reading
C Lower limiting value
D Upper limiting value
PF Programming window
PW Programming word
Us Threshold voltage
TS Clock signal
MZ Signal (measured time)
bo . . . b7 Control signals
a1 . . . a7 Control signals

What is claimed is:

1. A device for executing a method for programming time fuses of projectiles, wherein a disintegration time (T) which determines the firing time of a projectile is calculated and is inductively transmitted in the form of a multi-bit programming word to the projectile, wherein:

the disintegration time (T) is calculated from a predetermined muzzle velocity ($v_0$) of the projectile and a distance(s) from a target object;

the energy for a current supply is inductively transmitted prior to firing the projectile;

the disintegration time (T) is transmitted prior to firing the projectile; and the muzzle velocity during firing ($v_o'$) is measured, is checked for deviations from the predetermined muzzle velocity ($v_0$), and the disintegration time (T) is corrected to a new disintegration time (T') in such a way, that the product of the muzzle velocity during firing (Vo') and the new disintegration time (T') remains constant;

wherein a receiver coil (11) is provided in the device, which cooperates with a transmitter coil (12) for the purpose of transmitting a multi-bit programming word, and wherein a measuring device, which is disposed at the muzzle of the gun barrel, is provided for measuring the muzzle velocity of the projectile, wherein a comparator circuit (7) is provided, whose input side is connected with the receiver coil (11) and whose output side is connected with a decoder (8), the output of the decoder (8) is connected with a shift register (9), the output of which is connected with a first comparator (6), a first counter (1) is provided, which is connected with a clock generator (2) and with a programmable counter (3), wherein the first counter (1) is unblocked or blocked by start-stop pulses of the measuring device supplied by means of the receiver coil (11), the counter reading of the first counter (1) is transmitted to the programmable counter (3), whose input side can be connected with the clock generator (2) when the first counter (1) is blocked and which forms a clock signal for the control of the firing time, and that the output of the programmable counter (3) is connected via a binary circuit (4) to the input of a second counter (5), whose output is connected with the first comparator (6), wherein a firing signal (Z) appears at the output of the first comparator (6) when the counter reading of the second counter (5) and the reading of the shift register (9) corresponding to the disintegration time (T) are the same.

2. The device in accordance with claim 1, characterized in that the programmable counter (3) consists of a third counter (30) and a second comparator (31), wherein the outputs of the third counter (30) are connected with the inputs of the second comparator (31), the second comparator (31) has further inputs, which are each connected via respectively one gate arrangement (32) with outputs of the first counter (1), the output of the second comparator (31) is connected with a reset connector (R) of the third counter (3), and that pulses, which reset the third counter (30) and form the clock signal, appear at the output of the second comparator (31) every time the counter readings of the first and third counter (1, 30) are the same.

3. The device in accordance with claim 2, characterized in that the gate arrangement (32) consists of three NAND gates (33, 34, 35), each having respectively two inputs, wherein the outputs of the first two NAND gates (33, 34) are connected with the inputs of the third NAND gate (35), whose output is connected with the appropriate input of the second comparator (31), a predetermined counter reading (A) is present at the one inputs of the first NAND gates (33), while a first control signal (a7) is supplied to the other inputs, and the one inputs of the second NAND members (34) are connected with the appropriate outputs of the first counter (1), while a control signal (a7'), which is complementary to the first control signal (a7), is supplied to the other inputs.

4. The device in accordance with claim 3, characterized in that a third and fourth comparator (40, 41) are provided, at whose inputs the counter reading (B) of the first counter (1) is applied, the third and fourth comparator (40, 41) are connected via further inputs with respectively one memory member (42, 43) each, wherein a lower limiting value (C) is stored in the first memory member (42), and an upper limiting value (D) in the second memory member (43), the outputs of the third and fourth comparators (40, 41) are connected to the inputs of an OR gate (44), whose output is connected via a NAND gate (45) with the set input of an RS-flip-flop (46), whose output is connected with the gate arrangement (32), and that the first control signal (a7) appears at the output of the RS-flip-flop when the upper or lower limiting values (C, D) are downwardly or upwardly exceeded, wherein the predetermined counter reading (A) is transmitted to the second comparator (31) in place of the counter reading (B) of the first counter (1).

5. The device in accordance with claim 1, characterized in that the comparator circuit (7) consists of two comparators (V1, V2), whose inputs are connected via a voltage divider and a high-pass filter (13) with the receiver coil (11), and whose outputs are connected to inputs of AND gates (14, 15), each having two inputs, wherein the outputs of the AND gates (14, 15) are connected with the decoder (8).

6. The device in accordance with claim 1, characterized in that the input of a further comparator (V3) is connected to the receiver coil (11) via a resistor (R2) of a voltage divider, the output of the further comparator (V3) is connected via an inverter (16) and an AND gate (17) with the clock connector of a D-flip-flop (18), whose data input (D1) and complementary output (Q1') are connected with each other, and that signals, which are derived from the start-stop signals of the measuring device via the receiver coil (11), appear at the outputs (Q1, Q1') of the D-flip-flop (18) by means of which the first counter (1) can be unblocked or blocked.

7. The device in accordance with claim 1, characterized in that a further receiver coil (19) is provided which cooperates with a further transmitter coil (20) disposed inside a breech of the gun barrel, wherein three capacitors (22), which are series-connected with respectively one rectifier (21) each, are connected with the further receiver coil (19).

8. A device for executing a method for programming time fuses of projectiles, wherein a disintegration time (T) which determines the firing time of a projectile is calculated and is inductively transmitted in the form of a multi-bit programming word to the projectile, wherein:

the disintegration time (T) is calculated from a predetermined muzzle velocity ($v_0$) of the projectile and a distance(s) from a target object;

the energy for a current supply is inductively transmitted prior to firing the projectile;

the disintegration time (T) is transmitted prior to firing the projectile; and the muzzle velocity during firing ($v_0'$) is measured, is checked for deviations from the predetermined muzzle velocity ($v_0$), and the disintegration time (T) is corrected to a new disintegration time (T') in such a way, that the product of the muzzle velocity during firing (Vo') and the new disintegration time (T') remains constant;

wherein a receiver coil (11) is provided in the device, which cooperates with a transmitter coil (12) for the purpose of transmitting a multi-bit programming word, and wherein a measuring device for measuring the muzzle velocity of the projectile, which is disposed at the muzzle of the gun barrel, is provided, wherein a comparator circuit (7) is provided, whose input side is connected with the receiver coil (11) and whose output side is connected with a decoder (8), the output of the decoder (8) is connected with a shift register (9), the output of which is connected with a programmable counter (3), a first counter (1) is provided, which is connected with a clock generator (2) and a first comparator (6), wherein the first counter (1) is unblocked or blocked by start-stop pulses of the measuring device supplied by means of the receiver coil (11), the output of the programmable counter (3) is connected via a binary circuit (4) to the input of a second counter (5), whose output is connected with the first comparator (6), the input of the programmable counter (3) can be connected with the clock generator (2), if the first counter (1) is blocked, and forms a clock signal for the second counter (5), and that when the counter readings of the first and second counters (5,6) are the same, a firing signal (Z) appears at the output of the first comparator (6).

9. The device in accordance with claim 8, characterized in that the comparator circuit (7) consists of two comparators (V1, V2), whose inputs are connected via a voltage divider and a high-pass filter (13) with the receiver coil (11), and whose outputs are connected to inputs of AND gates (14, 15), each having two inputs, wherein the outputs of the AND gates (14, 15) are connected with the decoder (8).

10. The device in accordance with claim 9, characterized in that a control counter (26) is connected to one clock output (CP) of the decoder (8) connected with the shift register (8), whose output is connected with inputs of an AND gate (27), and at whose outputs a control signal (c5) appears, which indicates the complete transmission of the multi-bit programming word.

11. The device in accordance with claim 8, characterized in that the input of a further comparator (V3) is connected to the receiver coil (11) via a resistor (R2) of a voltage divider, the output of the further comparator (V3) is connected via an inverter (16) and an AND gate (17) with the clock connector of a D-flip-flop (18), whose data input (D1) and complementary output (Q1') are connected with each other, and that signals, which are derived from the start-stop signals of the measuring device via the receiver coil (11), appear at the outputs (Q1, Q1') of the D-flip-flop (18), by means of which the first counter (1) can be unblocked or blocked.

12. The device in accordance with claim 8, characterized in that the output frequency ($f_o'$) of the programmable counter (3) becomes proportional to an oscillator frequency ($f_o$).

13. The device in accordance with claim 8, characterized in that a further receiver coil (19) is provided which cooperates with a further transmitter coil (20) disposed inside a breech of the gun barrel, wherein three capacitors (22), which are series-connected with respectively one rectifier (21) each, are connected with the further receiver coil (19).

14. The device in accordance with claim 13, characterized in that the capacitors (22) are charged by the brief application of an alternating voltage of 20 kHz to the further transmitter coil (20).

15. The device in accordance with claim 8, characterized in that the outputs of the first counter (1) are connected via respectively one gate arrangement (32) with the inputs of the first comparator (6).

16. The device in accordance with claim 15, characterized in that a third and fourth comparator (40, 41) are provided, at whose inputs the counter reading (B) of the first counter (1) is applied, the third and fourth comparator (40, 41) are connected via further inputs with respectively one memory member (42, 43) each, wherein a lower limiting value (C) is stored in the first memory member (42), and an upper limiting value (D) in the second memory member (43), the outputs of the third and fourth comparators (40, 41) are connected to the inputs of an OR gate (44), whose output is connected via a NAND gate (45) with the set input of an RS-flip-flop (46), whose output is connected with the gate arrangements (32), and that the first control signal (a7) appears at the output of the RS-flip-flop when the upper or lower limiting values (C, D) are downwardly or upwardly exceeded, wherein the predetermined counter reading (A) is transmitted to the first comparator (6) in place of the counter reading (B) of the first counter (1).

17. The device in accordance with claim 8, characterized in that the outputs of the shift register (9) are connected with inputs of a second comparator (31) of the programmable counter (3).

* * * * *

UNITED STATES PATENT AND TRADEMARK OFFICE

CERTIFICATE OF CORRECTION

PATENT NO. : 5,787,785
DATED : Aug. 4, 1998
INVENTOR(S) : Klaus Muenzel et al.

It is certified that error appears in the above-identified patent and that said Letters Patent is hereby corrected as shown below:

On the title page, item [75], delete "Fluestrasse" and insert therefor --Klingnau-- and delete "Zilstrasse" and insert therefor --Hellberg--.

Signed and Sealed this

Twenty-second Day of December, 1998

*Attest:*

*Attesting Officer*

BRUCE LEHMAN

*Commissioner of Patents and Trademarks*